United States Patent [19]

Schnabl

[11] 4,064,587

[45] Dec. 27, 1977

[54] BROOM CONSTRUCTION

[76] Inventor: Martin Schnabl, c/o John Eppler Machine Works, Inc., 9150 State Road, Philadelphia, Pa. 19136

[21] Appl. No.: 702,977

[22] Filed: July 6, 1976

[51] Int. Cl.[2] ..... A46B 3/00; B25G 1/10

[52] U.S. Cl. ..... 15/175; 15/143 R; 15/189

[58] Field of Search ..... 15/143 R, 143 B, 145, 15/171, 175, 189, 207, 223, 225, 226; 93/1 B, 81 R

[56] References Cited

U.S. PATENT DOCUMENTS

| | | | |
|---|---|---|---|
| 748,370 | 12/1903 | Harris | 15/143 R X |
| 968,518 | 8/1910 | Post | 15/143 R |
| 986,294 | 3/1911 | Irick et al. | 15/143 R |
| 1,757,853 | 5/1930 | Carbone | 15/226 X |
| 1,993,215 | 3/1935 | Hoyt et al. | 93/1 B UX |
| 2,237,969 | 4/1941 | Olsen | 15/143 R |
| 2,666,223 | 1/1954 | Farrel | 15/225 X |

FOREIGN PATENT DOCUMENTS

| | | | |
|---|---|---|---|
| 362,735 | 4/1906 | France | 15/143 R |
| 1,127,738 | 8/1956 | France | 15/171 |
| 412,292 | 11/1966 | Switzerland | 15/143 R |

*Primary Examiner*—Daniel Blum

*Attorney, Agent, or Firm*—Z. T. Wobensmith, 2nd; Z. T. Wobensmith, III

[57] ABSTRACT

A broom is provided having a handle formed of convolutely wound and glued paper, with a wooden plug insert at one end for attachment of the broom and its end wire binding or end cover, a cap being provided on the free end of the handle.

4 Claims, 4 Drawing Figures

BROOM CONSTRUCTION

BACKGROUND OF THE INVENTION

1. Field of the Invention

This invention relates to broom handles.

2. Description of the Prior Art

It has heretofore been customary to use wooden handles for brooms but it is becoming more and more difficult and expensive to find suitable wood for this purpose.

It has heretofore been proposed as shown in the U.S. Pat. to Irick et al., No. 986,294, to employ a hollow or tubular body portion constructed of paper and with strips wound spirally upon each other to form a plurality of layers, the joints of the spiral strips of the several layers being arranged to break joint with each other. Within the spirally wound tube a tubular lining is provided to form a brace to strengthen the handle and to impart rigidity to the same. The metallic lining can be tubular, as shown in FIG. 3, corrugated as shown in FIG. 4, or tubular with diagonally disposed braces as in FIG. 5. The metallic lining is intended to extend throughout the entire length of the body portion of the handle to impart strength and rigidity and at the same time providing a light handle construction. The tube is coated to render it more durable and an outer tube or cover of paper is also provided.

The U.S. Pat. to Halford, Jr., No. 2,667,655, shows a tooth cleaning device, the handle of which is of helical or spirally wound paper held by a water soluble adhesive such as glue.

The spirally wound tubes of Irick et al., and of Halford, Jr. tend in use to fail along one of the spiral windings and do not inherently develop the strength required.

The metallic tubular linings of Irick et al. are not suited for attachment of broom structure by nails or staples.

SUMMARY OF THE INVENTION

In accordance with the invention a handle for brooms is provided consisting of a convolutely wound and glued paper tube with an inserted wooden pin or dowel at one end and at the location at which the broom straws or strands are attached whether by employing a wire binding at the upper end of the broom or a clamping band for the upper end of the strands, broom attaching elements extending into and engaging the wooden pin or dowel. If an end cover is provided for the broom this may also be secured in place by a fastener extending into and engaging the wooden pin or dowel.

It is the principal object of the invention to provide a handle for brooms which is simple and inexpensive to construct, which is preferably made of paper and which has greater strength than handles of paper heretofore available.

It is a further object of the invention to provide a handle for brooms which is light in weight but sturdy and which will have a long useful life.

It is a further object of the invention to provide a handle for brooms which is readily usable with various types of brooms now in use.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
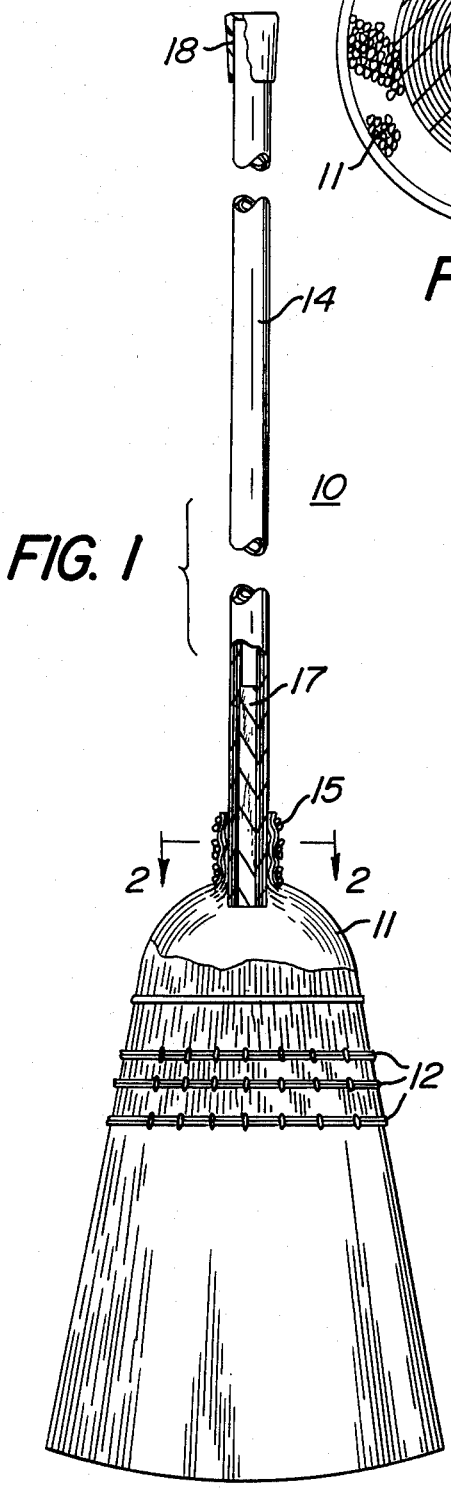
FIG. 1 is a side elevational view of one type of broom having a handle in accordance with the invention, parts being broken away to show the details of construction.
Figure 2:
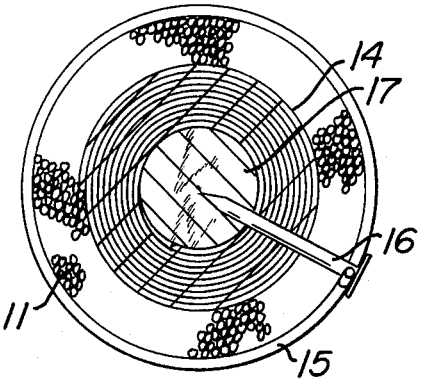
FIG. 2 is a horizontal sectional view, enlarged, taken approximately on the line 2—2 of FIG. 1.

Referring now more particularly to FIGS. 1 and 2 of the drawings, a broom 10 is there illustrated having a head 11 of straw or other desired material which may be held by lines of stitches 12 in a well known manner and which has a plurality of strands at the upper end of the head 11 bound onto the handle 14 by wire windings 15, the free end of which is held by a nail 16.

The handle 14 is composed of convolutely wound paper, kraft paper with long fibers being preferable. The paper, during the convolute winding is preferably coated with a waterproof glue so that upon drying the respective convolute windings will remain in engagement.

In a specific embodiment the handle 14 can be of a length of forty-two inches and of an external diameter in accordance with the size of the head 11 in the range from thirteen sixteenths of an inch to one and one eighth inches.

Within the lower end of the tube for the handle 14, a wooden plug or pin 17, preferably of a diameter of one half inch and of a length of the order of seven inches is provided into which the nail 16 extends in engagement. The plug or pin 17 is preferably secured in place by a suitable adhesive.

The handle 14 preferably has, at the upper end thereof, a cap 18.

Figure 3:
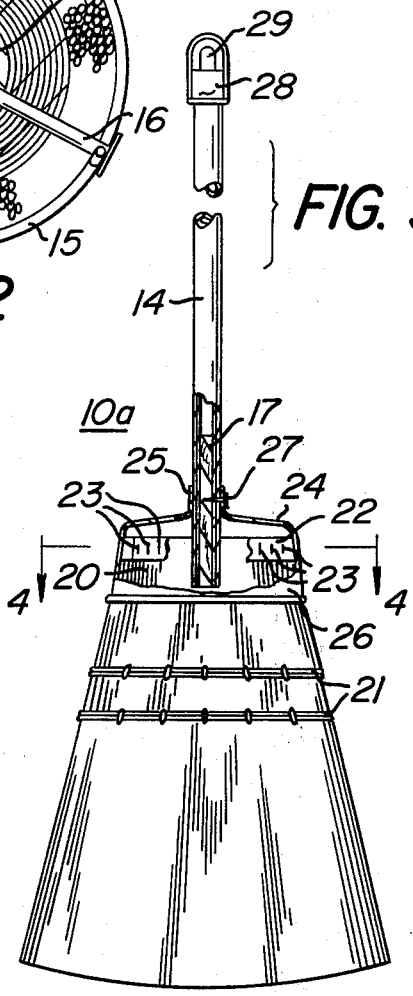
FIG. 3 is a side elevational view of another type of broom having a handle in accordance with the invention, parts being broken away to show the details of construction.
Figure 4:
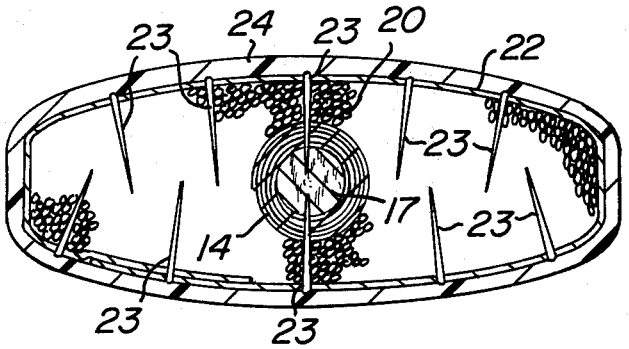
FIG. 4 is a horizontal sectional view, enlarged, taken approximately on the line 4—4 of FIG. 3.

Referring now to FIGS. 3 and 4, a different broom construction 10A is there illustrated which includes a handle 14, as previously described, a broom head 20, preferably of stiff strands of synthetic plastic material held together by lines of stitches 21, and with their upper terminal ends enclosed within and retained by a metal band 22. A plurality of fasteners 23, preferably staples, extend through the metal band 22 and into the head 21. One or more fasteners 23 extends into the handle 14 and the plug or pin 17 therein.

A cover 24, preferably of synthetic plastic material is provided with a collar 25 disposed in engagement with the handle 14 and a skirt portion 26 extending downwardly over the top of the broom head 20 and below the band 22. The collar 25 can be secured in place in any desired manner such as by frictional gripping engagement with the handle 14 and a fastener 27, such as a nail, can be inserted therethrough and into the plug or pin 17.

The upper end of the handle 14 of the broom 20*a* is shown as having a cap 28 thereon with an eye 29 for hanging the broom 20*a* on a hook (not shown).

I claim:

1. A broom comprising a handle which includes a convolute round paper tube having the turns thereof adhesively secured together, a wooden plug adhesively held in engagement within one end of said tube for broom head attachment to the tube and plug, a cap at the opposite end of the tube from the plug and closing said opposite end, and a broom head secured to said tube and said plug by a fastener engaging the head and handle and extending into the plug.

2. A broom as defined in claim 1 in which said broom head is retained on the handle by a wire winding and said fastener engaged with said winding and extending into said plug.

3. A broom as defined in claim 1 in which said broom head is retained on the handle by a metal band engaging the head and a plurality of fasteners extending through said band and engaging said head, and at least one of said fasteners extends into said plug.

4. A broom as defined in claim 1 in which said broom head has a cover with a neck portion retained on said handle and a skirt portion extending over part of said head.

* * * * *

UNITED STATES PATENT OFFICE

CERTIFICATE OF CORRECTION

Patent No. 4,064,587 Dated December 27, 1977

Inventor(s) Martin Schnabl

It is certified that error appears in the above-identified patent and that said Letters Patent are hereby corrected as shown below:

Column 3,

Line 11, after "convolute", "round" should be - wound -

Signed and Sealed this

Twenty-eighth Day of March 1978

[SEAL]

Attest:

RUTH C. MASON
Attesting Officer

LUTRELLE F. PARKER
Acting Commissioner of Patents and Trademarks